US009376194B1

(12) United States Patent
Jensen et al.

(10) Patent No.: US 9,376,194 B1
(45) Date of Patent: Jun. 28, 2016

(54) IDLE RELIEF MUFFLERS AND OUTBOARD MOTORS HAVING IDLE RELIEF MUFFLERS

(71) Applicant: Brunswick Corporation, Lake Forest, IL (US)

(72) Inventors: Daniel W. Jensen, Oshkosh, WI (US); Scott G. Ahlswede, Plymouth, WI (US); Andrew S. Waisanen, Fond du Lac, WI (US); Charles H. Eichinger, Oshkosh, WI (US)

(73) Assignee: Brunswick Corporation, Lake Forest, IL (US)

( * ) Notice: Subject to any disclaimer, the term of this patent is extended or adjusted under 35 U.S.C. 154(b) by 66 days.

(21) Appl. No.: 14/306,794

(22) Filed: Jun. 17, 2014

(51) Int. Cl.

| | |
|---|---|
| ***B63H 21/32*** | (2006.01) |
| ***F01N 1/08*** | (2006.01) |
| ***F01N 13/00*** | (2010.01) |
| ***B63H 20/24*** | (2006.01) |

(52) U.S. Cl.
CPC ..... *B63H 20/245* (2013.01); *F01N 13/004* (2013.01)

(58) Field of Classification Search
CPC ..... B63H 20/24; B63H 20/245; F01N 13/004
USPC ..... 440/88 R, 89 B, 89 C, 89 H, 89 J
See application file for complete search history.

(56) References Cited

U.S. PATENT DOCUMENTS

| | | | | |
|---|---|---|---|---|
| 4,668,199 | A | 5/1987 | Freund et al. | |
| 4,781,021 | A | 11/1988 | Winberg | |
| 4,952,182 | A | 8/1990 | Curtis et al. | |
| 7,001,231 | B1 | 2/2006 | Halley et al. | |
| 7,485,019 | B1 * | 2/2009 | Macier | B63H 20/32 181/204 |
| 9,039,469 | B1 * | 5/2015 | Calamia | B63H 20/02 440/53 |
| 2013/0280970 | A1 | 10/2013 | Clarkson et al. | |
| 2014/0057508 | A1 | 2/2014 | Litjens et al. | |

* cited by examiner

*Primary Examiner* — Daniel V Venne
(74) *Attorney, Agent, or Firm* — Andrus Intellectual Property Law, LLP

(57) ABSTRACT

Idle relief mufflers are configured to discharge exhaust gases from an outboard motor to atmosphere surrounding the outboard motor when an internal combustion engine of the outboard motor is operated at idle and at low speeds. The idle relief mufflers comprise a housing having an open interior, an inlet port configured to convey the exhaust gases to the open interior, and an outlet port configured to discharge the exhaust gases from the open interior. An exhaust grommet is connected to the outlet port. The exhaust grommet comprises a body that is configured to engage with a cowl of the outboard motor and an extension that extends through the outlet port and protrudes into the open interior. The extension and the body together define a through-bore that is configured to convey the exhaust gases from the open interior to the atmosphere.

20 Claims, 7 Drawing Sheets

IDLE RELIEF MUFFLERS AND OUTBOARD MOTORS HAVING IDLE RELIEF MUFFLERS

FIELD

The present disclosure relates to idle relief mufflers and outboard motors having idle relief mufflers.

BACKGROUND

The following U.S. Patents and Publications are incorporated herein by reference.

U.S. Pat. No. 4,668,199 discloses an exhaust system for an outboard motor that includes a main exhaust passageway extending through a partially water filled chamber in the drive shaft housing. An inlet idle relief passage connects the top of the chamber with the main exhaust passageway and an outlet passage connects the top of the chamber with the atmosphere.

U.S. Pat. No. 4,781,021 discloses a marine engine exhaust muffler assembly that includes inlet and outlet members, the axes of which are offset from each other. A muffler housing is disposed between the inlet and outlet members and forms a chamber having disposed therein an annular multi-layered cartridge. The layers have a multiplicity of perforations therein for passage of exhaust gases and spent engine cooling water there through. The water assists in keeping the muffler clean. An imperforate arcuate blocking plate is nested within the lower portion of the cartridge to permit accumulation of the spent engine cooling water within the cartridge to aid in noise reduction at certain engine speeds. The blocking plate is provided with a relief opening means for assisting in water drainage upon engine shutoff.

U.S. Pat. No. 4,952,182 discloses an exhaust relief system for an outboard motor that includes an exhaust chamber into which exhaust is discharged from the engine. A first passage in communication with the exhaust chamber provides contraction of the exhaust as the exhaust passes rearwardly, from which the exhaust is discharged into an expansion chamber which substantially surrounds the exhaust chamber. From the expansion chamber, the exhaust is routed through and contracted into a second passage in communication with the expansion chamber, after which it is discharged to atmosphere. The tortuous path provided by the exhaust relief system, along with the repeated expansion and contraction of the exhaust as it flows to atmosphere, provides a muffling effect at idle operation.

U.S. Pat. No. 7,001,231 discloses a water cooling system for an outboard motor that provides a water conduit that extends through both an idle exhaust relief passage and a primary exhaust passage. Water within the water conduit flows through first and second openings to distribute sprays or streams of water into first and second exhaust conduits which can be the primary and idle exhaust relief passages of an outboard motor.

U.S. Patent Application Publication No. 2013/0280970 discloses a marine propulsion system for propelling a marine vessel in water. The system comprises a marine vessel and an outboard motor that is coupled to the marine vessel. The outboard motor has a first inlet that receives intake air for combustion. A second inlet is located on the hull of the marine vessel and a conduit conveys the intake air from the second inlet on the marine vessel to the first inlet on the outboard motor. The system comprises an outboard motor that is coupled to a marine vessel, and that comprises an exhaust gas relief outlet that is located above the water when the outboard motor is at idle speed. A conduit conveys exhaust gas from the exhaust gas relief outlet to a discharge outlet located on the marine vessel.

SUMMARY

This Summary is provided to introduce a selection of concepts that are further described below in the Detailed Description. This Summary is not intended to identify key or essential features of the claimed subject matter, nor is it intended to be used as an aid in limiting the scope of the claimed subject matter.

In certain examples, an idle relief muffler is configured to discharge exhaust gases from an outboard motor to atmosphere surrounding the outboard motor when an internal combustion engine of the outboard motor is operated at idle and at low speeds. The idle relief muffler comprises a housing having an open interior, an inlet port configured to convey the exhaust gases to the open interior, and an outlet port configured to discharge the exhaust gases from the open interior. An exhaust grommet is connected to the outlet port. The exhaust grommet comprises a body that is configured to engage with a cowl of the outboard motor and an extension that extends through the outlet port and protrudes into the open interior. The extension and the body together define a through-bore that is configured to convey the exhaust gases from the open interior to the atmosphere.

In certain examples, outboard motors having the idle relief mufflers described herein above are disclosed.

In certain examples, methods are disclosed for making an idle relief muffler configured to discharge exhaust gases from the internal combustion engine to atmosphere surrounding the outboard motor when the outboard motor is operated at idle and at low speeds. The methods can comprise: forming the housing having an open interior, the inlet port configured to convey the exhaust gases to the open interior, and the outlet port configured to discharge the exhaust gases from the open interior; forming the exhaust grommet, which is configured to connect to the outlet port; and selecting an axial length of the extension of the grommet relative to the outlet port to achieve a certain exhaust noise when the internal combustion is operated in idle gear.

BRIEF DESCRIPTION OF THE DRAWINGS

Examples of idle relief mufflers for outboard motors are described with reference to the following Figures. The same numbers are used throughout the Figures to reference like features and like components.

DETAILED DESCRIPTION OF THE DRAWINGS

In the present description, certain terms have been used for brevity, clarity and understanding. No unnecessary limitations are to be inferred therefrom beyond the requirement of the prior art because such terms are used for descriptive purposes only and are intended to be broadly construed.

Figure 1:
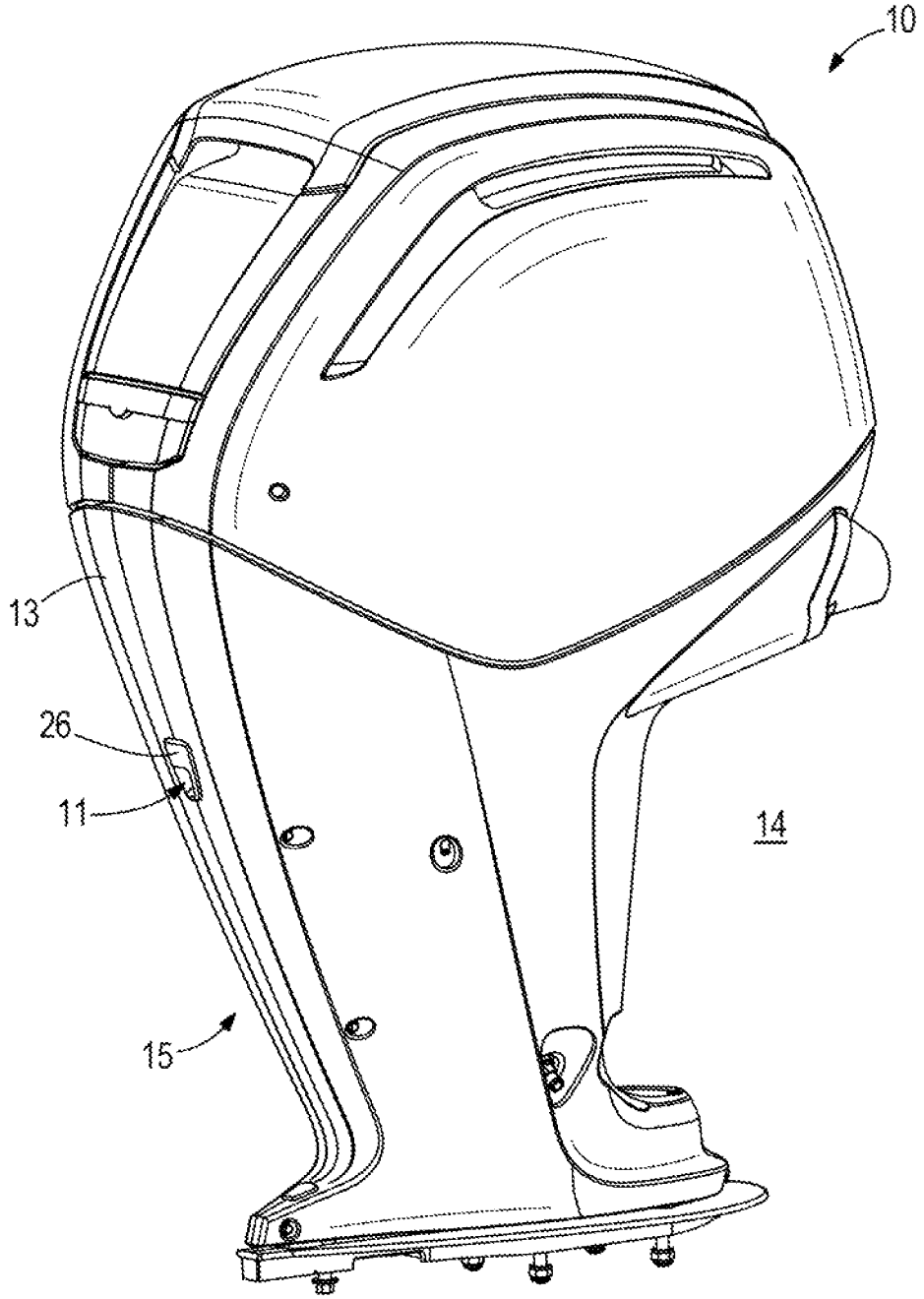
FIG. 1 is a perspective view of a portion of an outboard motor having an idle relief outlet.

FIG. 1 depicts an outboard motor 10 having an idle relief outlet 11 for discharging idle relief gases from an internal combustion engine (not shown) on the outboard motor 10. The idle relief outlet 11 is located in the cowl 13 of the outboard motor 10 along a rear side 15 of the outboard motor 10. The idle relief outlet 11 is vertically positioned on the outboard motor 10 so that it remains above water when the outboard motor 10 is operated at idle and at low speeds and the marine vessel (not shown) to which the outboard motor 10 is attached is in a stationary position. The location of the idle relief outlet 11 can vary from that which is shown. The configuration of the outboard motor 10 and the cowl 13 also can vary from that which is shown.

Figure 2:
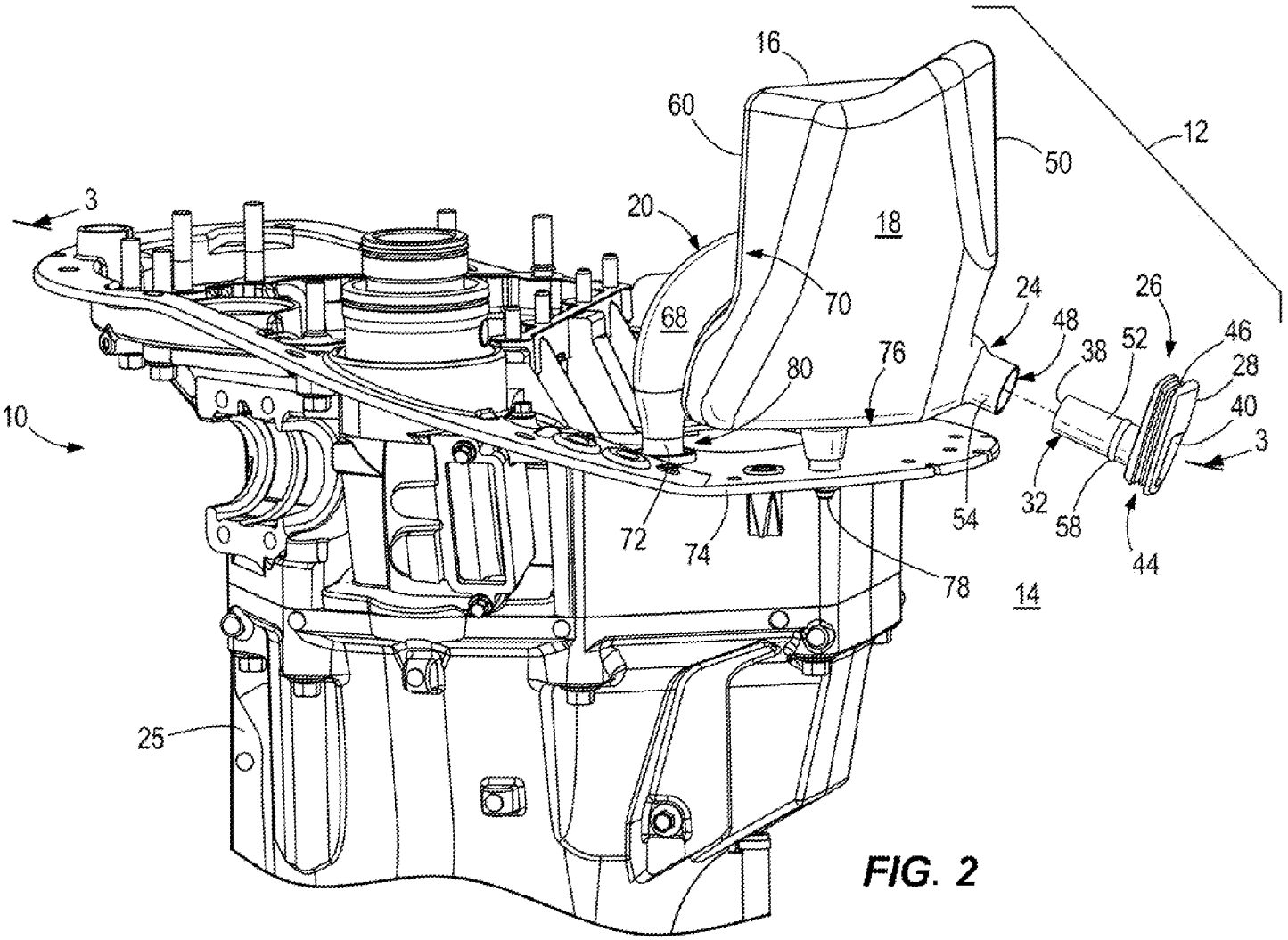
FIG. 2 is a perspective view of a midsection of the outboard motor and an idle relief muffler for discharging exhaust gases from the outboard motor to atmosphere surrounding the outboard motor via the idle relief outlet when an internal combustion engine of the outboard motor is operated at idle and at low speeds.
Figure 3:
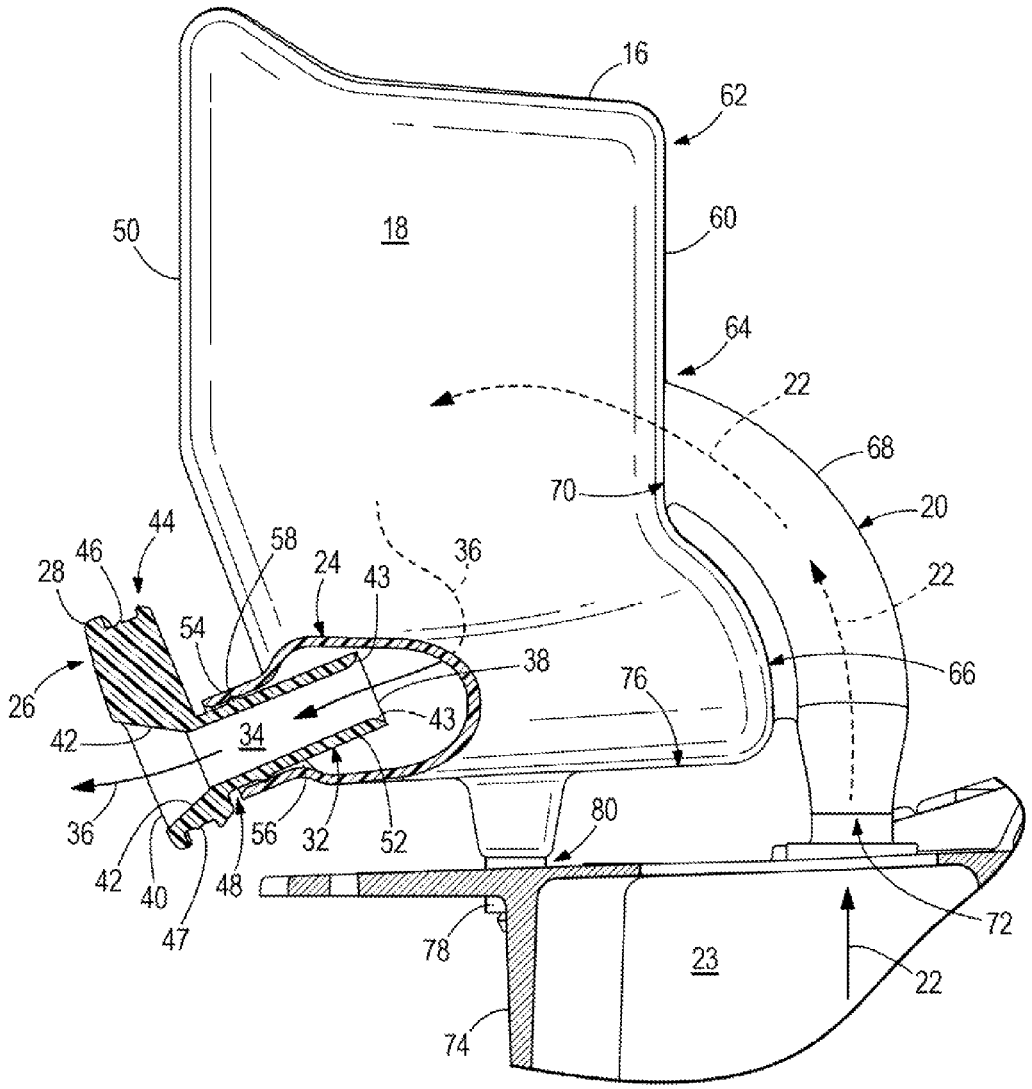
FIG. 3 is a side view of the idle relief muffler shown in FIG. 2.

FIGS. 2-3 depict an idle relief muffler 12 that is configured to discharge the exhaust gases from the outboard motor 10 to the atmosphere 14 surrounding the outboard motor 10 via the idle relief outlet 11 shown in FIG. 1. The idle relief muffler 12 includes a housing 16 having an open interior 18. An inlet port 20 conveys the exhaust gases (at arrows 22) from a cavity 23 in the driveshaft housing 25 of the outboard motor 10 to the open interior 18. An outlet port 24 is configured to discharge the exhaust gases from the open interior 18. An exhaust grommet 26 is connected to the outlet port 24. The exhaust grommet 26 includes a body 28 that is configured to engage with the cowl 13 of the outboard motor 10 (as shown in FIG. 1). The exhaust grommet 26 also includes an extension 32 that is configured to extend through the outlet port 24 of the housing 16 and protrude into the open interior 18 (as shown in FIG. 3). Together, the extension 32 and the body 28 define a through-bore 34 that is configured to convey the exhaust gases from the open interior 18, through the cowl 13 to the atmosphere 14, as shown at arrows 36.

Figure 4:
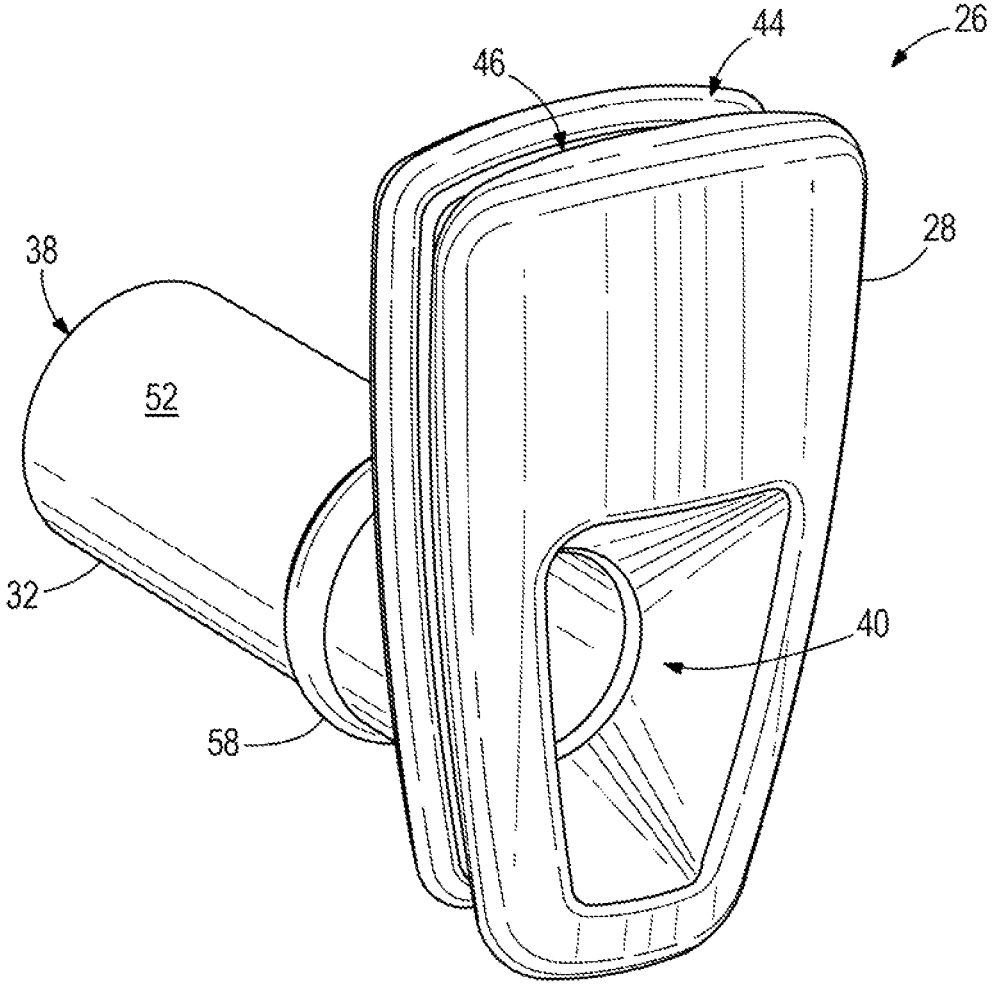
FIG. 4 is a perspective view of an exhaust grommet for the idle relief muffler.
Figure 5:
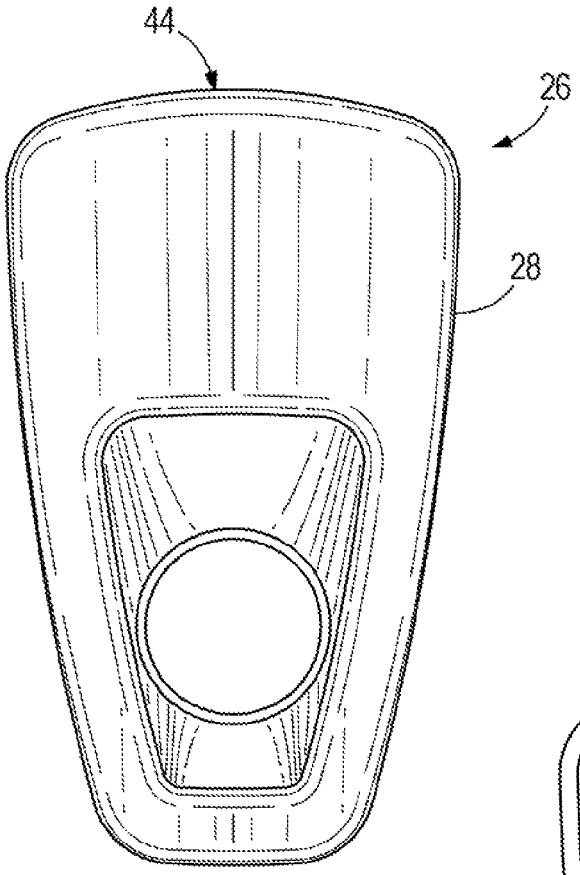
FIG. 5 is a rear view of the exhaust grommet.
Figure 6:
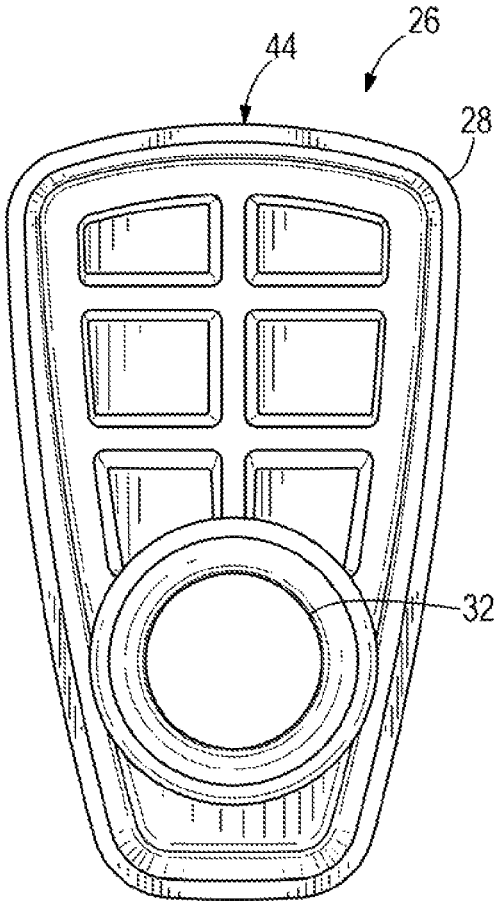
FIG. 6 is a front view of the exhaust grommet.
Figure 7:
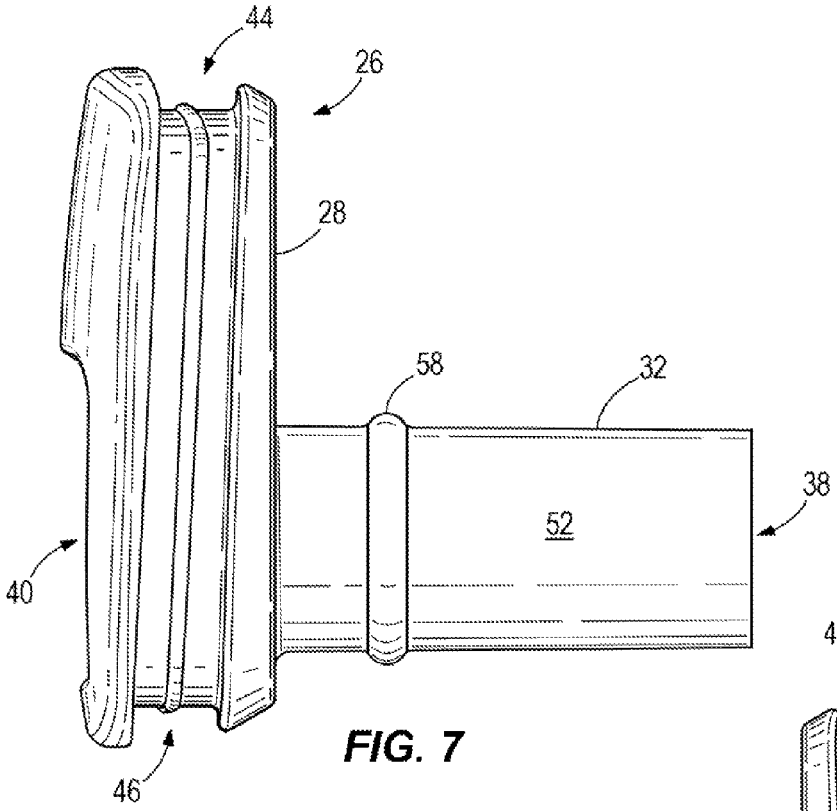
FIGS. 7 and 8 are right and left side views of the exhaust grommet.
Figure 8:
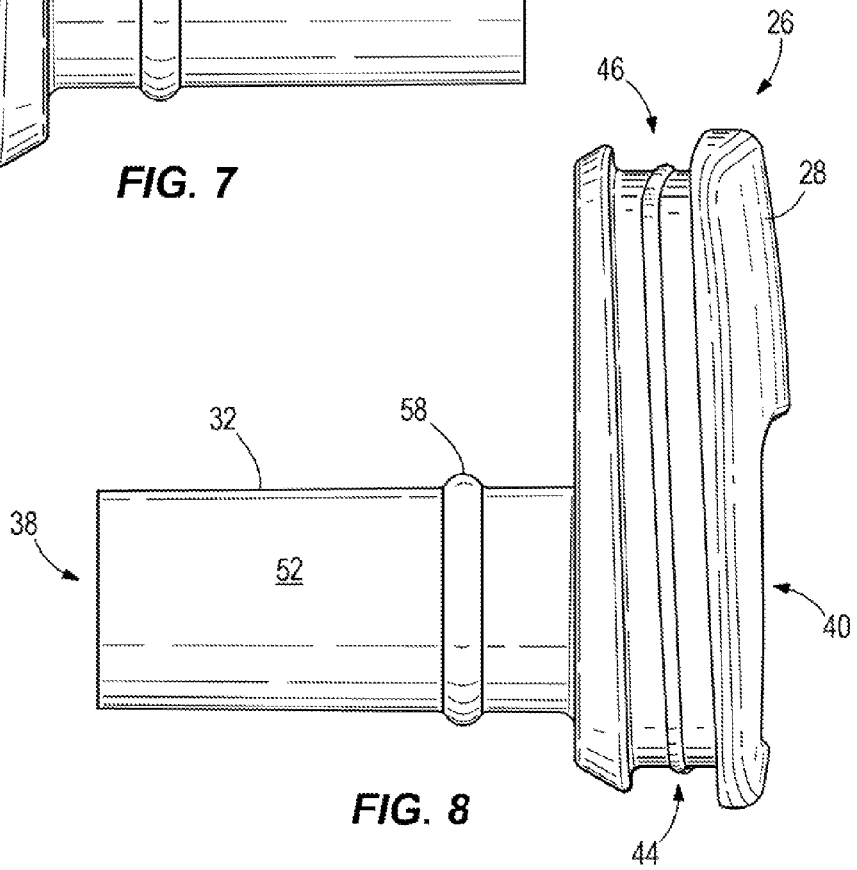
Figure 9:
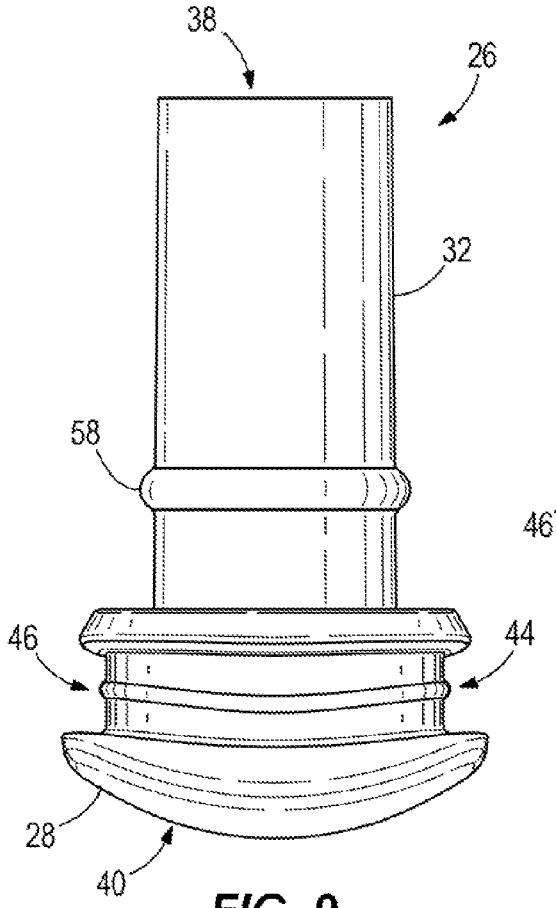
FIGS. 9 and 10 are top and bottom views of the exhaust grommet.
Figure 10:
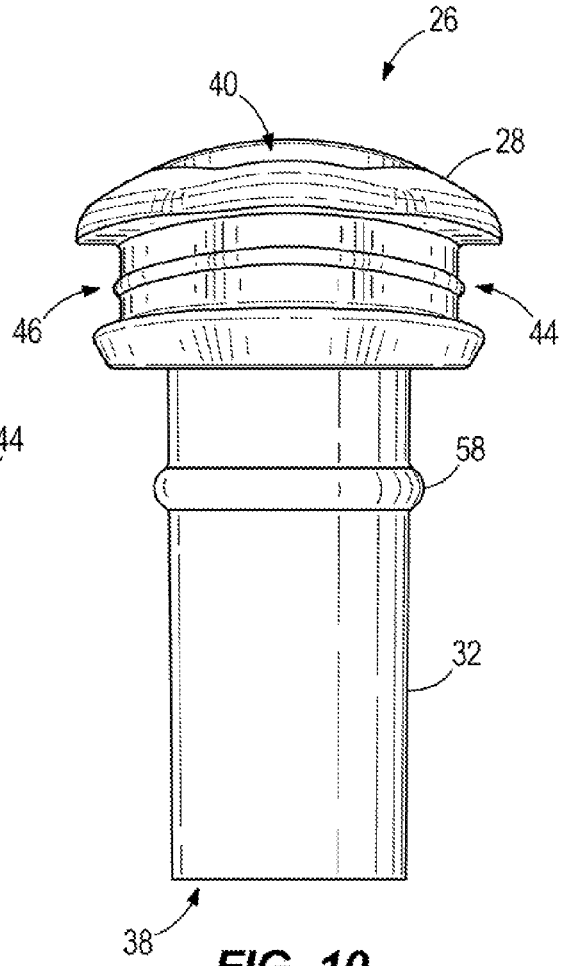

As shown in FIG. 3, the extension 32 engages with the outlet port 24 in a friction fit. Specifically, the extension 32 has an outer diameter and the outlet port 24 has an inner diameter. The outer diameter of the extension 32 is slightly larger than the inner diameter of the outlet port 24 so that when the extension 32 is inserted into the outlet port 24, the surface of the extension 32 engages with the surface of the outlet port 24 and a seal is formed between the extension 32 and the outlet port 24. The through-bore 34 has an inlet end 38 for receiving the exhaust gases from the open interior 18 and an outlet end 40 for discharging the exhaust gases through the cowl 13 at the idle relief outlet 11. The outlet end 40 is funnel-shaped so that it has tapered edges 42 when viewed in the cross-section of FIG. 3. FIGS. 4 and 5 more clearly show the funnel shape. The body 28 includes a radially outer circumference 44 having a circumferential channel 46 that has one or more circumferential ribs 47 and is configured to engage with an inner radial edge of an opening in the cowl 30 of the outboard motor 10 at the idle relief outlet 11, as shown in FIG. 1. The housing 16 of the idle relief muffler 12 includes a sidewall 50 having an opening 48 that forms part of the outlet port 24. The inlet end 38 of the extension 32 extends into the open interior 18, protruding away from and apart from the sidewall 50 and the opening 48 in the sidewall 50.

The extension 32 has an outer circumferential surface 52. The outlet port 24 has an outlet conduit 54 that protrudes outwardly from the open interior 18. The outlet conduit 54 has an inner circumferential surface 56. The inner circumferential surface 56 engages with the outer circumferential surface 52 to form the noted seal. A raised rib 58 is disposed on the outer circumferential surface 52. The raised rib 58 engages with the inner circumferential surface 56 of the outlet conduit 54 to thereby enhance the noted seal.

The housing 16 includes an opposite sidewall 60 having a top portion 62, a lower portion 66, and a middle portion 64 disposed between the top portion 62 and lower portion 66. The inlet port 20 includes an inlet conduit 68 having a first end 70 connected to the middle portion 64 of the sidewall 60 and a second end 72 that is connected to an interior surface of the outboard motor 10, which in this example is an adapter plate 74 for supporting the noted internal combustion engine, for receiving the exhaust gases from an interior cavity 23 in the driveshaft housing 25. The housing 16 further includes a bottom wall 76 and a nipple 78 that protrudes outwardly away from the bottom wall 76 and away from the open interior 18. The nipple 78 is configured to engage with an opening 80 formed in the noted interior surface of the outboard motor 10 to thereby support the idle relief muffler 12 with respect to the outboard motor 10. The exhaust grommet 26 can be formed of rubber, for example. The housing 16 can be formed of plastic, for example.

Through research and experimentation, the present inventors have determined that it is desirable to provide an idle relief muffler having improved sound quality while maintaining low cost of manufacture and increased applicability to outboard motor cowl designs. It was also found to be desirable to provide an idle muffler apparatus that is easy to assemble. The present disclosure provides such an idle relief muffler apparatus, wherein the grommet provides a tunable muffler element having an extension that protrudes through the housing and into the open interior of the housing. Certain embodiments disclosed herein allow for more complex muffler designs, such as for example an extended tube resonator, to be added to the outboard motor without added cost or complexity to a blow-molded muffler part. Certain embodiments disclosed herein maximize the volume available in the expansion chamber due to packaging constraints as the muffler outlet no longer needs to be molded integral to the housing of the muffler itself. Certain embodiments provide a grommet configuration that eliminates potential for gap(s) between the grommet and the outlet of the housing, thus limiting turbulence and noise. During manufacture, the housing and the exhaust grommet are formed, and advantageously, through experimentation, the axial length of the extension can be selected to achieve certain exhaust noises when the internal combustion is operated. This can result in improved sound level and quality without unnecessary added cost or complexity of the apparatus. Further, the grommet and housing can be configured such that these items can be installed prior to or after installation of the cowling, providing flexibility and ease of assembly. Connecting the inlet conduit at the middle portion of the housing can advantageously provide increased attenuation of exhaust noise. The funnel-shape on the inlet end of extension of the grommet can prevent adverse noise, such as whistling noise that could otherwise occur. The grommet and housing can be configured to be self-aligning with the cowl at the idle relief outlet, thus providing additional ease of assembly. Selecting the length of the extension relative to the outlet port can change the noise of the exhaust gases during flow at the idle relief outlet, thus providing tune-ability and affording best-in-class idle sound quality. At higher engine speeds, flow reversal can occur, during which air is pulled into the muffler, leading to a potential whistle noise. The smooth transitions into and out of the grommet help reduce this noise. These and other advantages will be recognized from embodiments of the present disclosure by those having ordinary skill in the art.

In the present description, certain terms have been used for brevity, clearness and understanding. No unnecessary limitations are to be implied therefrom beyond the requirement of the prior art because such terms are used for descriptive purposes only and are intended to be broadly construed. The different systems and methods described herein may be used alone or in combination with other systems and methods. Various equivalents, alternatives, and modifications are possible within the scope of the appended claims.

What is claimed is:

1. An idle relief muffler configured to discharge exhaust gases from an outboard motor to atmosphere surrounding the outboard motor when an internal combustion engine of the outboard motor is operated at idle and at low speeds, the idle relief muffler comprising:

an idle relief muffler housing having an open interior, an inlet port configured to convey the exhaust gases to the open interior, and an outlet port configured to discharge the exhaust gases from the open interior; and an exhaust grommet connected to the outlet port, wherein the exhaust grommet comprises a body that is configured to engage with a cowl of the outboard motor and an extension that is configured to extend through the outlet port and protrude into the open interior of the idle relief muffler housing, wherein the extension and the body together define a through-bore that is configured to convey the exhaust gases from the open interior to the atmosphere.

2. The idle relief muffler according to claim 1, wherein the extension engages with the outlet port and forms a seal therebetween.

3. The idle relief muffler according to claim 1, wherein the extension has an outer diameter and wherein the outlet port has an inner diameter, and wherein the outer diameter of the extension is larger than the inner diameter of the outlet port so that when the extension is inserted into the outlet port, the extension engages with the outlet port and forms a seal therebetween.

4. The idle relief muffler according to claim 1, wherein the through-bore has an inlet end for receiving the exhaust gases and an outlet end for discharging the exhaust gases, and wherein the inlet end is funnel-shaped.

5. The idle relief muffler according to claim 1, wherein the body comprises a radially outer circumference having a channel that is configured to engage with an inner radial edge of an opening in a cowl of the outboard motor.

6. The idle relief muffler according to claim 1, wherein the outlet port comprises an opening in a sidewall of the idle relief muffler housing and wherein the extension comprises an inlet end that extends into the open interior, apart from the opening in the sidewall.

7. The idle relief muffler according to claim 6, wherein the extension comprises an outer circumferential surface; wherein the outlet port comprises an outlet conduit that protrudes outwardly away the open interior; and wherein the outlet conduit comprises an inner circumferential surface that engages with the outer circumferential surface of the extension in a friction fit.

8. The idle relief muffler according to claim 7, comprising a raised rib that is disposed on the outer circumferential surface of the extension, wherein the raised rib engages with the inner circumferential surface of the outlet conduit and enhances the seal.

9. The idle relief muffler according to claim 1, wherein the idle relief muffler housing comprises a sidewall having a top portion, lower portion, and middle portion located between the top portion and the lower portion, and wherein the inlet port comprises an inlet conduit having a first end connected to the middle portion and a second end configured to connect to an interior surface of the outboard motor for receiving exhaust gases from a driveshaft idle relief muffler housing of the outboard motor.

10. The idle relief muffler according to claim 1, wherein the idle relief muffler housing comprises a bottom wall; and further comprising a nipple protruding outwardly from the bottom wall away from the open interior, the nipple configured to engage with an opening in an interior surface of the outboard motor to support the idle relief muffler in the outboard motor.

11. An outboard motor, comprising:

an internal combustion engine;

an idle relief muffler configured to discharge exhaust gases from the internal combustion engine to atmosphere surrounding the outboard motor when the outboard motor is operated at idle and at low speeds;

wherein the idle relief muffler comprises an idle relief muffler housing having an open interior, an inlet port configured to convey the exhaust gases to the open interior, and an outlet port configured to discharge the exhaust gases from the open interior; and wherein the idle relief muffler comprises an exhaust grommet connected to the outlet port, wherein the exhaust grommet comprises a body and an extension that extends through the outlet port and protrudes into the open interior, wherein the extension and the body together define a through-bore that is configured to convey the exhaust gases from the open interior to the atmosphere.

12. The outboard motor according to claim 11, further comprising a cowl, wherein the body of the exhaust grommet is engaged with the cowl.

13. The outboard motor according to claim 11, wherein the extension has an outer diameter and wherein the outlet port has an inner diameter, and wherein the outer diameter of the extension is larger than the inner diameter of the outlet port so that when the extension is inserted into the outlet port, the extension engages with the outlet port to form a seal therebetween.

14. The outboard motor according to claim 11, wherein the through-bore has an inlet end for receiving the exhaust gases and an outlet end for discharging the exhaust gases, and wherein the inlet end is funnel-shaped.

15. The outboard motor according to claim 11, further comprising a cowl, wherein the body comprises a radially outer circumference having a channel that is engaged with an inner radial edge of an opening in the cowl.

16. The outboard motor according to claim 11, wherein the outlet port comprises an opening in a sidewall of the idle relief muffler housing and wherein the extension comprises an inlet end that extends into the open interior, apart from the opening in the sidewall.

17. The outboard motor according to claim 16, wherein the extension comprises an outer circumferential surface; wherein the outlet port comprises an outlet conduit that protrudes outwardly away the open interior; and wherein the outlet conduit comprises an inner circumferential surface that engages with the outer circumferential surface of the extension to form a seal therebetween; and further comprising a raised rib that is disposed on the outer circumferential surface of the extension, wherein the raised rib engages with the inner circumferential surface of the outlet conduit and enhances the seal.

18. The outboard motor according to claim 11, wherein the idle relief muffler housing comprises a sidewall having a top portion, middle portion and lower portion, and wherein the inlet port comprises an inlet conduit having a first end connected to the middle portion and a second end connected to an interior surface of the outboard motor.

19. The outboard motor according to claim 11, wherein the idle relief muffler housing comprises a bottom wall; and further comprising a nipple protruding outwardly from the bottom wall away from the open interior, wherein the nipple is engaged with an opening in an interior surface of the outboard motor to support the idle relief muffler in the outboard motor.

20. A method of making an idle relief muffler configured to discharge exhaust gases from the internal combustion engine to atmosphere surrounding the outboard motor when the outboard motor is operated at idle and at low speeds, the method comprising:

forming an idle relief muffler housing having an open interior, an inlet port configured to convey the exhaust gases to the open interior, and an outlet port configured to discharge the exhaust gases from the open interior, forming an exhaust grommet that is configured to connect to the outlet port, wherein the exhaust grommet comprises a body and an extension that extends through the outlet port and protrudes into the open interior, wherein the extension and the body together define a throughbore that is configured to convey the exhaust gases from the open interior to the atmosphere; and selecting an axial length of the extension relative to the outlet port to achieve a certain exhaust noise when the internal combustion is operated in idle gear.

* * * * *